US006036175A

United States Patent [19]

Harper

[11] Patent Number: 6,036,175

[45] Date of Patent: Mar. 14, 2000

[54] ELECTRIC SECURITY PANELS

[75] Inventor: Graham Harper, Coventry, United Kingdom

[73] Assignee: Gallagher Security Europe Ltd., Coventry, United Kingdom

[21] Appl. No.: 08/853,127

[22] Filed: May 8, 1997

[51] Int. Cl.[7] ..... E04H 17/00

[52] U.S. Cl. ..... 256/1; 256/10

[58] Field of Search ..... 256/10, 11, 1, 256/65, 12; 174/161 F, 163 F, 158 F; 340/564; 52/101

[56] References Cited

U.S. PATENT DOCUMENTS

| | | | |
|---|---|---|---|
| 1,130,287 | 3/1915 | Horvath | 256/11 X |
| 2,101,040 | 12/1937 | Bayley et al. . | |
| 2,801,823 | 8/1957 | Clements | 256/10 |
| 3,515,417 | 6/1970 | Bowman | 403/372 X |
| 3,516,643 | 6/1970 | Cox | 256/10 |
| 3,771,767 | 11/1973 | Dougherty | 256/11 |
| 3,861,084 | 1/1975 | Ford | 256/12 X |
| 4,005,397 | 1/1977 | Blair | 256/1 X |
| 4,293,778 | 10/1981 | Williams . | |
| 4,327,358 | 4/1982 | Karas | 340/564 X |
| 4,525,701 | 6/1985 | Leih | 256/10 X |
| 4,571,578 | 2/1986 | Karas | 340/564 X |
| 4,730,809 | 3/1988 | Stoler | 256/10 X |
| 4,916,433 | 4/1990 | Ver Loren van Themaat | 256/12 X |
| 4,920,331 | 4/1990 | Ver lOren Van Themaat et al. | 256/12 X |
| 4,986,513 | 1/1991 | Schultz et al. | 256/65 |
| 5,150,885 | 9/1992 | Leone | 256/65 X |
| 5,152,508 | 10/1992 | Fish . | |
| 5,461,364 | 10/1995 | Sanford, Jr. et al. | 256/11 X |

FOREIGN PATENT DOCUMENTS

| | | | |
|---|---|---|---|
| 118518 | 6/1944 | Australia | 256/10 |
| 0191115 | 8/1986 | European Pat. Off. . | |
| 2592512 | 7/1987 | France | 256/10 |
| 329816 | 11/1920 | Germany | 256/10 |
| 3706999 | 9/1987 | Germany | 256/10 |
| 3837902 | 3/1990 | Germany | 256/10 |
| 9318762 | 5/1994 | Germany . | |
| 622851 | 4/1981 | Switzerland . | |
| 794840 | 5/1958 | United Kingdom | 256/10 |

*Primary Examiner*—Harry C. Kim
*Attorney, Agent, or Firm*—Wood, Phillips, VanSanten, Clark & Mortimer

[57] ABSTRACT

A panel can be assembled with similar panels to form a security fence or other barrier. The panel carries at least one wire connected, in use, to a source of high tension impulse electrical voltage. The wire is housed to prevent contact therewith except where penetration of the housing occurs. Panels can be positioned on or above the top of an existing fence or other barrier. An electric fence kit is also provided for erection of an electric fence in an existing fence. The kit includes a plurality of wires to be electrified, at least two posts, and mounting structure for mounting the posts in the existing fence and a plurality of guides for each post. Each guide is for guiding one of the wires, in use.

17 Claims, 14 Drawing Sheets

ELECTRIC SECURITY PANELS

The invention relates to electrical security panels which can be assembled to form a fence or other barrier.

For many years, electric fencing has been used in the agricultural environment for the control and containment of animals. In more recent times, electric fencing has been used in security applications for the protection of persons and property. However, it is necessary for such electric fencing to be applied to or to be used in conjunction with an existing perimeter wall, fence or other boundary to prevent innocent persons from accidentally coming into contact with the security fencing and receiving an electric shock. In that respect, wires carrying the normal high tension voltage are fitted to a fence which is at least 1.8 meters high or need to be spaced from the fence to prevent inadvertent contact therewith by persons. At the same time, the spacing from the fence should not be sufficiently great to create an area between the fence and the high tension wire where a person could become trapped.

Such systems as outlined above can be used where there is an existing perimeter fence. However, temporary security fencing systems are becoming used more extensively these days where a number of portable fence panels are assembled around, for example, building sites, plant and machinery, excavations and other areas where security, health and safety are of importance. Previously, such fences have consisted of straightforward metal fence panels which are connected together to form a suitable security fence. In more recent times, electronic security has been applied in conjunction with such panels including acoustic cabling, fibre optics, vibration sensors and low voltage detection loops. To date, the portable panel security systems have not been particularly successful primarily due to cost and poor reliability. For example, shock sensors easily give false alarms and low voltage detection loops can be subject to induced currents which, again, trigger false alarms.

An object of the present invention is to provide electric security panels which can be assembled into fencing and which are reliable in use.

According to one aspect of the invention there is provided a panel which can be assembled with similar panels to form a security fence or other barrier, the panel carrying at least one wire connected in use to a source of high tension impulsed electrical voltage, the wire being housed to prevent contact therewith except where penetration of the housing occurs.

With such a panel, penetration of the housing by an intruder will result in the intruder possibly receiving an electric shock thereby deterring further interference with the panel and/or causing an alarm to be signalled. Such an arrangement is advantageous over the systems proposed hitherto. Whilst interference with the known fence panels may cause an alarm to be given, the intruder does not run the risk of receiving an electric shock and may continue to penetrate the fencing and remove articles intended to be protected by the fence.

Preferably, the wire is housed within a hollow member of the panel such as a tube or a member of insulating material. Preferably, a plurality of such hollow members may be provided which form an array of spaced apart bars at least some of which house the wire connected, in use, to the high tension electrical voltage.

Advantageously, the panel may comprise at least one moulding and the or each wire is housed within the panel.

According to a second aspect of the invention there is provided a panel which can be assembled with similar panels to form a security fence or other barrier, the panel comprising at least one moulding and carrying at least one wire connected, in use, to a source of electrical voltage, the or each wire being housed within the panel.

The wire may be moulded into the panel during the moulding process. Alternatively, the moulded panel may be constructed from a plurality of moulded sections which interconnect so as to house the wire between them. The use of moulding to form the panel or panel sections is particularly advantageous in that the scope of colour choice of the panel is very wise and the panel will be relatively light in weight and easy to transport. Also moulding lends itself well to mass production of the panels.

The panel may include upper and lower sections. In such a case, the upper section can be positioned out of normal reach and can carry an exposed wire connected to the or another source of high tension electrical voltage.

In another arrangement, the panel may comprise a flexible net, mesh or the like which is formed from or carries the wire. In such a case, the wire may be housed within a coating of insulating material.

Penetration of the coating of insulating material by an intruder will result in the intruder possibly receiving an electric shock. However, the insulating material itself normally prevents contact with the high tension wire.

The panel may include connector means by which it can be connected to an adjacent panel. Preferably, the connector means provides an electrical connection between the wires of adjacent panels through which the high tension electric voltage can travel. In that way, interconnecting panels through the connector means will automatically electrically interconnect the panels. That particular arrangement makes the assembly of a security fence particularly easy. Once the various panels of the fence have been assembled, it is not necessary then to go around the entire fence and make separate electrical connections between the panels.

The connector means may comprise a socket on the panel which receives a spigot on the adjacent panel, the socket and spigot including or comprising electrically conductive elements which are brought into electrical contact when the spigot is received into the socket. In one embodiment the socket includes a plurality of electrically conductive elements which are spaced apart and insulated from each other and the spigot also includes a plurality of electrically conductive elements which are spaced apart and insulated from each other, the electrically conductive elements of the socket being arranged to make electrical contact with the respective electrically conductive elements of the spigot when the spigot is received into the socket.

Alternatively the spigot may comprise a rotatable pin having a bayonet-type connector recess therein which can be engaged with the electrically conductive element of the socket by inserting the pin into the socket and then rotating the pin.

The connector means may be hinge-like. In that way, adjacent panels can be arranged at an angle to each other thereby enabling the panels to be positioned as required around an area or article to be protected.

The panel may have four or more edges at least three of which have said connector means thereon.

Preferably all the edges of the panel have said connector means thereon.

In certain cases, intermediate free-standing posts may be provided between the panels and the connector means on the panels may be arranged to connect the panels to connectors on the posts. Preferably, the connectors on the posts are also electrically interconnected to enable the high tension voltage to travel from one panel to the other via the connectors on the posts.

According to a third aspect of the invention a fence panel is provided which can be assembled with similar panels to form a security fence, the fence panel being positioned on or above the top of an existing fence or barrier and including an exposed wire connected or to be connected to a source of high tension voltage. Such a panel can effectively form an electrified capping for an existing non-electrified wall or fence. The panel may have a plurality of spaced apart wires or wire sections thereon.

The source of high tension voltage for a panel in accordance with the invention may be in the form of an electric fence energiser which may be of a known kind typically used in an agricultural application.

Detector means may be provided on the panel or on a said post to detect when penetration of the wire housing occurs. The detector may be arranged to transmit a signal to a receiver which is arranged to cause operation of an alarm. The receiver may be associated with a system which provides an indication as to which sensor has transmitted the signal. In that way, the relevant fence panel from which the signal has been transmitted can be readily identified.

According to a fourth aspect of the invention there is provided a fence panel which can be assembled with similar panels to form security fence via fixing means on the panel, the panel including exposed wiring connected, in use, to a source of high tension impulsed electrical voltage.

The fence panel in accordance with the latter aspect of the invention may include both high and low tension wiring, the two wirings being normally spaced from each other but movable into mutual contact in the event of an intrusion to enable an indication to be given that such an intrusion is taking place or has taken place.

In any of the aforesaid aspects of the invention or any of the consistory clauses relating thereto, the panel may have two sets of wires in non-electrical contact with each other, one of said wires being arranged to carry the said high tension voltage and the other wire being arranged to carry a low tension voltage.

Circumstances also arise where there is an existing permanent or temporary fence but the security of electrification is required.

According to a further aspect of the invention there is provided an electric fence kit for erection of an electric fence on an existing fence, the kit comprising a plurality of wires to be electrified, at least two posts, mounting means for mounting the posts on the existing fence and a plurality of guide means for each post, each guide means being for guiding one of said wires, in use.

Thus, the kit can be erected on an existing fence to provide an electrified security fence on the existing fence.

The guide means or the posts may be insulating. Preferably, the guide means are insulating and the posts may then conveniently be made from metal. On the other hand, where the posts are insulting, the guide means are preferably made of metal and may be made from wire.

The mounting means may take any suitable form and may comprise means for mounting a post in an upwardly facing opening defined in an existing fence. Each mounting means may comprise a mounting member of resilient material and each mounting member then preferably comprises a ring of resilient material to be resiliently received on one of the posts.

The kit may further comprise means for connection to earth for the existing fence.

According to another aspect of the invention there is provided the combination of an existing fence and an electric fence erected from a kit according to the last preceding aspect of the invention, the posts being mounted on the existing fence by the mounting means, a plurality of guide means being carried by each post and the wires extending in spaced apart arrangement between the guide means.

The electric fence may be mounted in any desired relation to the existing fence and in a preferred embodiment it is arranged immediately above the existing fence. Preferably, the existing fence includes tubular upright members and each post of the electric fence is mounted by the mounting means in the upwardly facing opening defined in the end of a said tubular upright member.

The existing fence may be of any suitable type. The invention may find particular application where the existing fence is a temporary fence and where the existing fence is a non-electric fence. Preferably the existing fence is conductive, for example, being made of metal, and is connected to earth.

Electric security panels and fencing in accordance with the invention will now be described by way of example with reference to the accompanying drawings in which.

Figure 12:
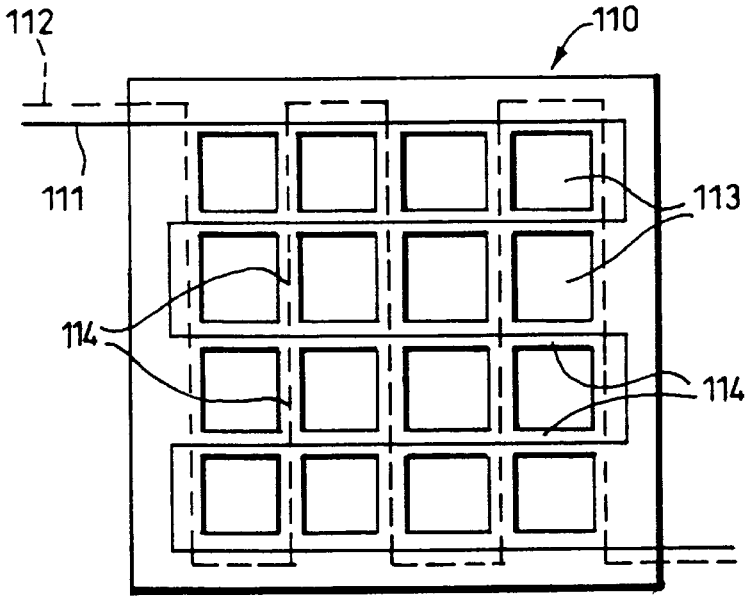
FIG. 12 illustrates another form of moulded panel in accordance with the invention.
Figure 12A:
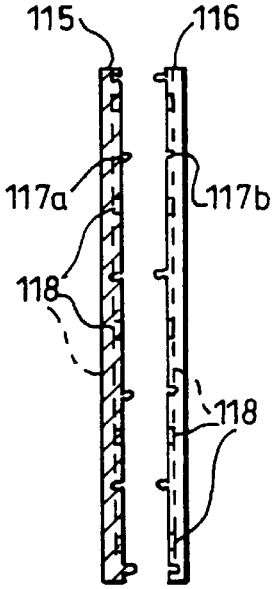
Figure 13:
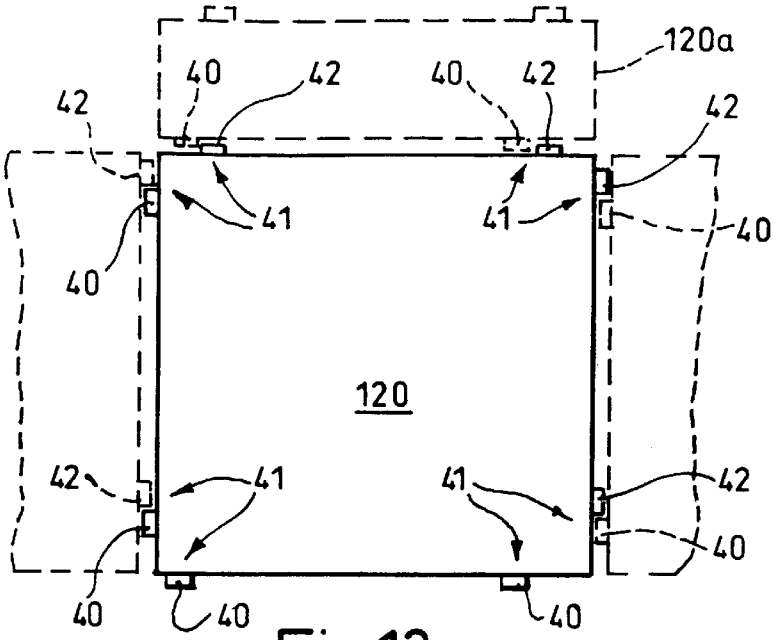
Figure 13A:
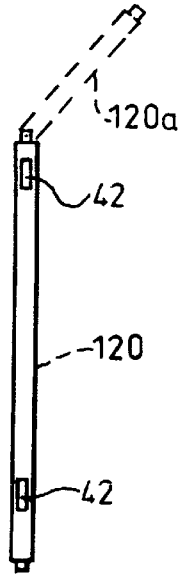
Figure 15:
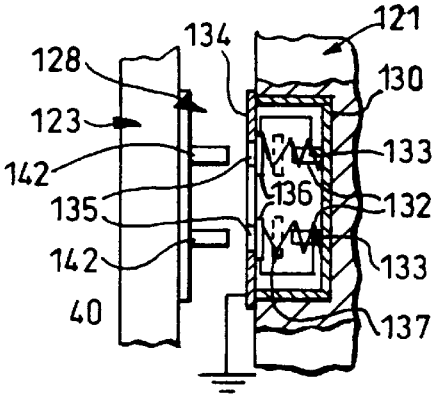
Figure 14:
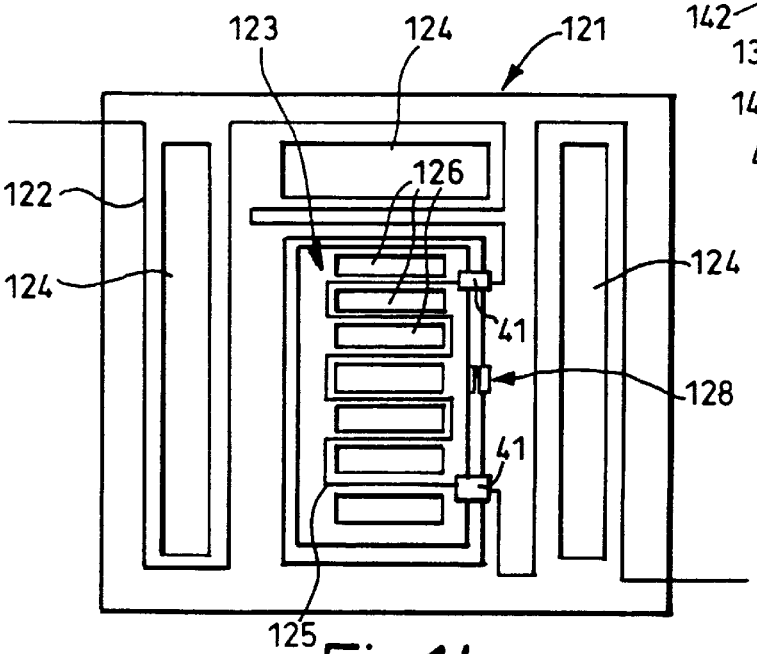
Figure 16:
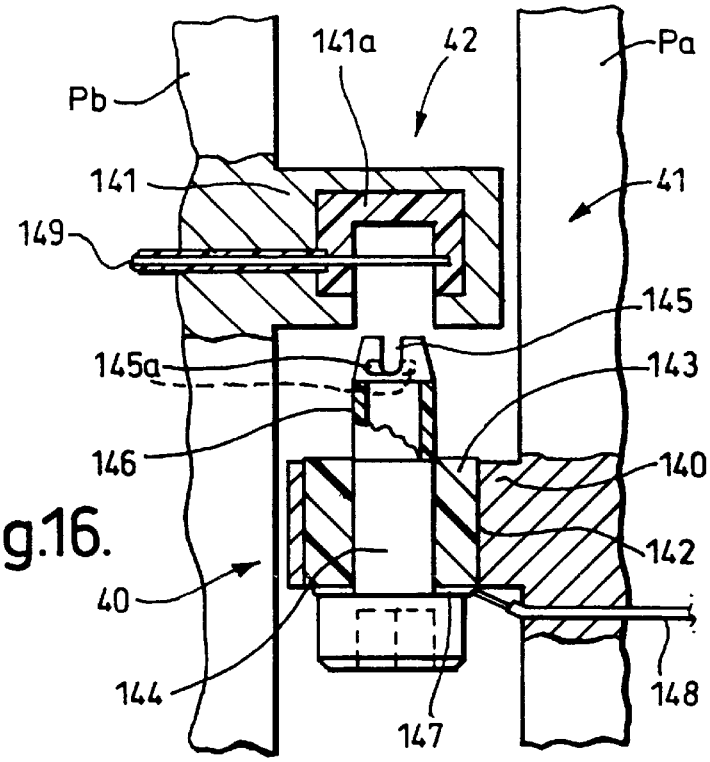
Figure 17:
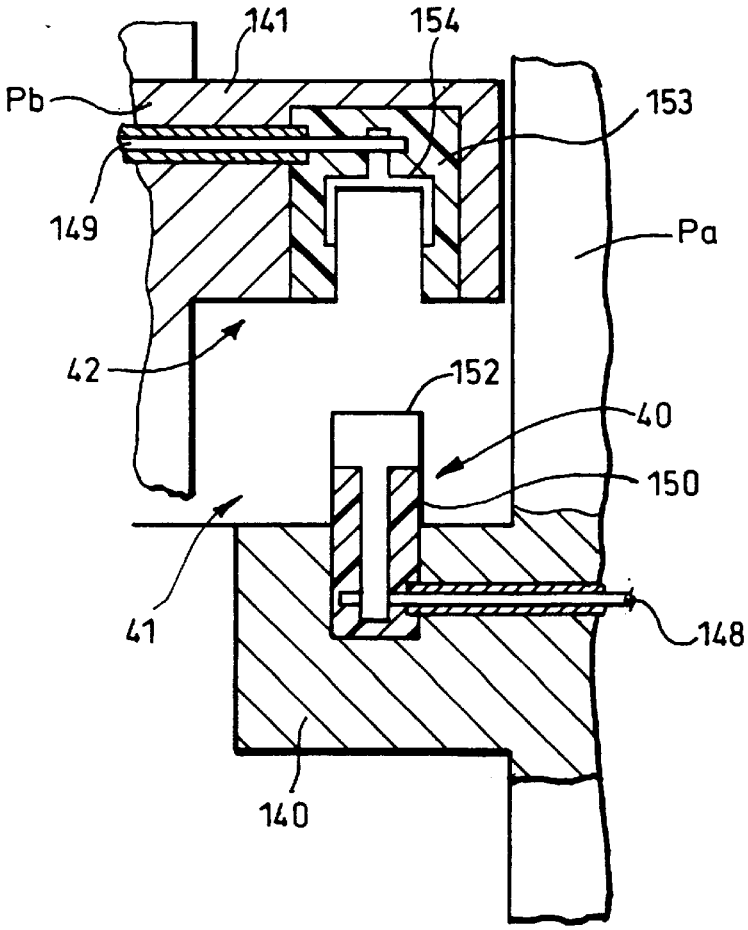
Figure 18:
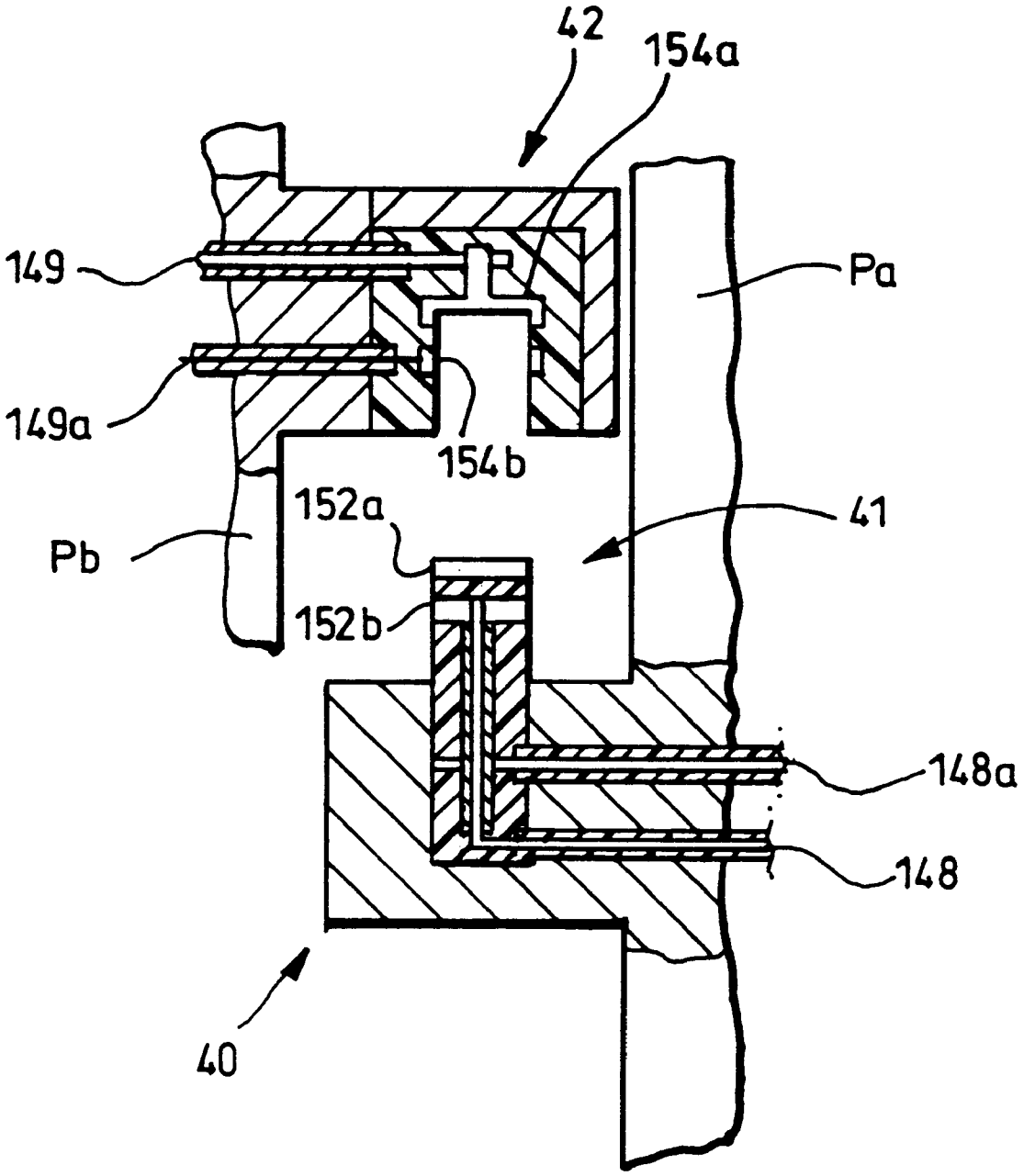
Figure 19:
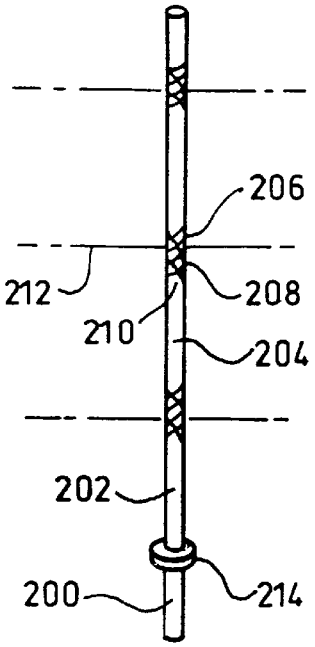
Figure 20:
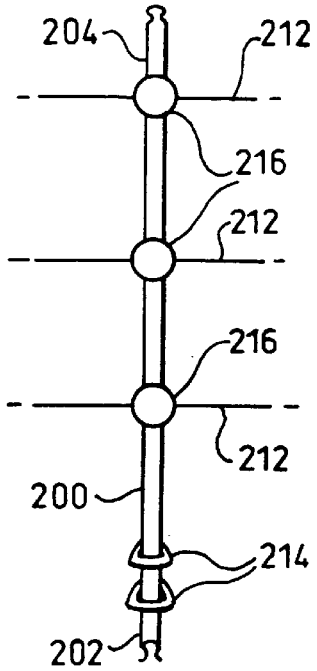
Figure 21:
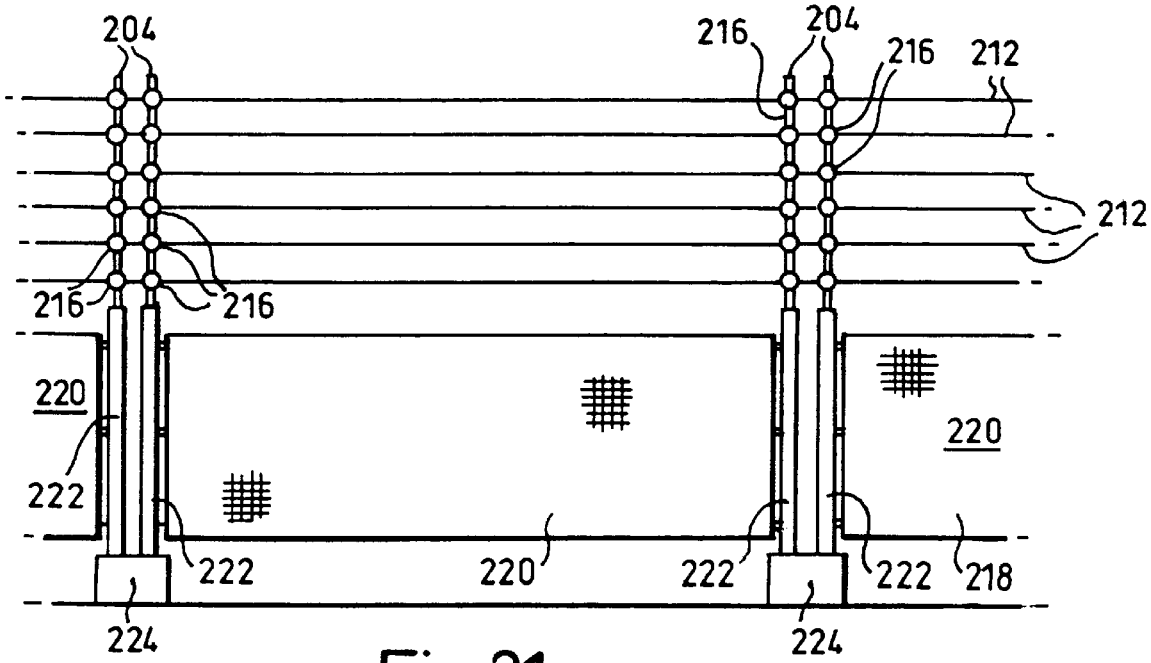

FIG. 12*a* illustrates a two-part moulded panel;

FIG. 13 is a diagrammatic view of a panel in accordance with the invention having connectors on all four edges;

FIG. 13*a* is an end view of the panel shown in FIG. 13;

FIG. 14 is a diagrammatic view of a panel in accordance with the invention which incorporates a door;

FIG. 15 is a diagrammatic view of a switch operable by opening and closing the door in FIG. 14;

FIG. 16 is a cross-section through one form of connector for a panel in accordance with the invention having a bayonet-type electrically conductive element;

FIG. 17 is a cross-section through a different type of connector for a panel in accordance with the invention;

FIG. 18 is a cross-section similar to FIG. 17 and showing the way in which the connector can be arranged to interconnect two wires of the interconnected panels;

FIG. 19 illustrates a post and associated parts of a kit for forming a fence according to the invention;

FIG. 20 illustrates a post and associated parts of an alternative kit for forming a fence in accordance with the invention; and, FIG. 21 illustrates an existing temporary fence with a fence formed from the kit of the type shown in FIG. 20 thereon.

Figure 1:
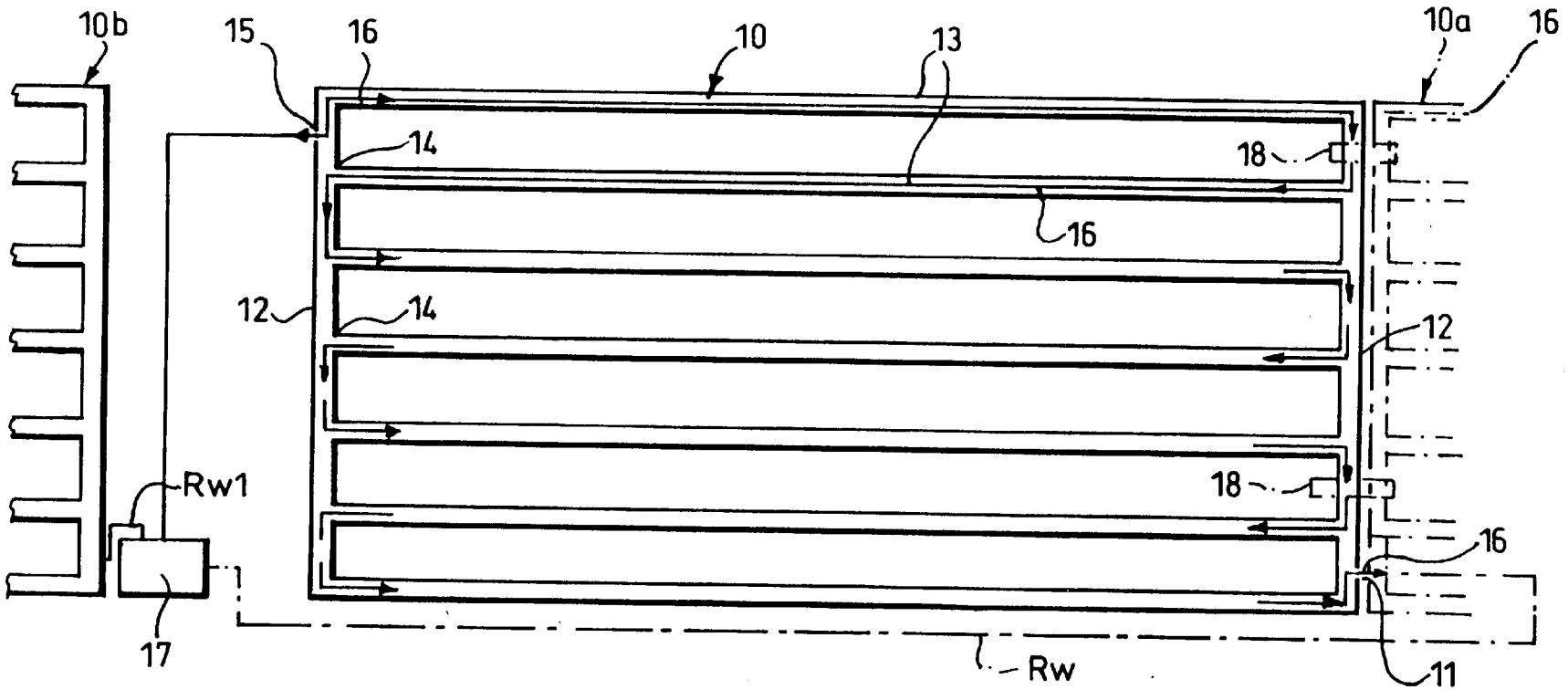
FIG. 1 is a fence panel in accordance with the invention having a plurality of horizontal tubes containing wire connected to a high tension voltage.

In FIG. 1, a portable fence panel 10 comprises vertical end tubes 12 which are interconnected by horizontal tubes 13. The tubes 13 locate in apertures 14 in the end tubes 12 so as to interconnect the hollow interiors of the tubes 12, 13.

An insulated wire 16 passes through an aperture 15 in the left hand end tube 12 as viewed in FIG. 1 and from there passes in zig-zag fashion through the interiors of the tubes 12, 13 so as eventually to emerge from an aperture 11 in the right hand end tube 12. The wire 16 is connected to an energiser 17 (eg a G218H/V L/V monitoring system available from Gallagher Security (UK) Ltd Coventry) which provides a high tension voltage as a series of impulses for the wire 16 and monitoring of the panel 10. The system senses voltage change due to tampering with the panel and can operate an alarm. The tubes 12 and 13 will normally be made from steel but the insulation on the wire 16 prevents high tension voltage from being conducted to the steel tubing. A suitable return path from the wire emerging from aperture 11, eg an earth return, may be used. Alternatively, a wire return Rw can be provided back to the energiser 17.

If the insulation on the wire 16 is penetrated, eg by attempting to saw through one of the tubes 12, 13, the person making the saw cut will risk receiving an electric shock from the wire 16 and creating an alarm where an alarm system is utilised as with the G218 H/V L/V monitoring system.

The panel 10 in FIG. 1 may be connected to the adjacent portable panels 10*a*, 10*b* by suitable connectors 18 to form a temporary security fence to the electrified and monitored by the energiser 17. The wire 16 emerging from the aperture 11 in the right hand end tube 12 is then suitably connected to wire 16 in the panel 10*a*. Any suitable number of panels 10, 10*a*–10*c* etc may be interconnected to form a run of fencing, a return path RW1 being provided from the last panel 10*c* of the run. (In FIG. 1 the panel 10*c* will normally be connected to panel 10*a* by the connectors 18).

Figure 2:
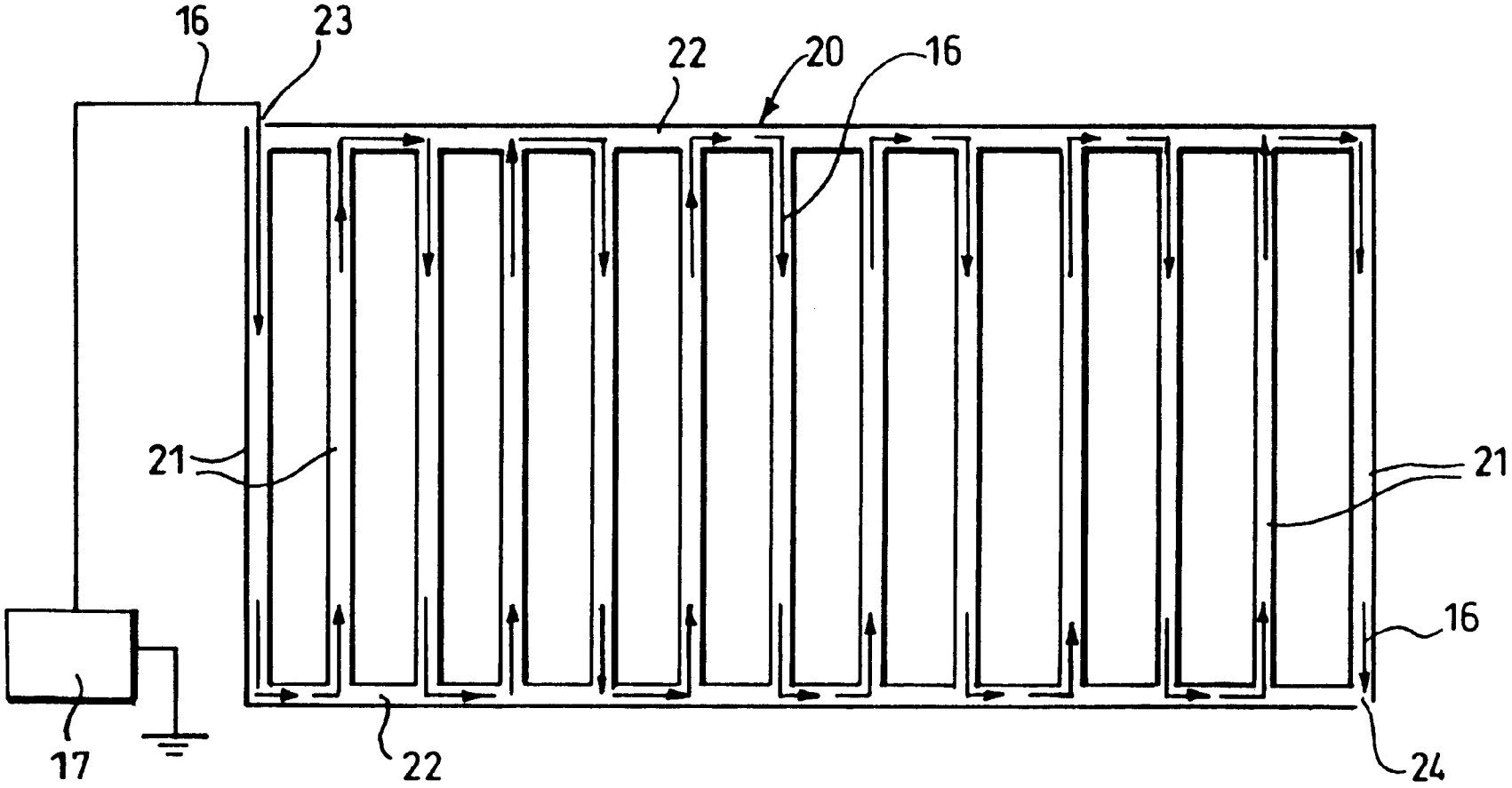
FIG. 2 is a further fence panel in accordance with the invention having a plurality of vertical tubes containing wire connected to a high tension voltage.

FIG. 2 shows a panel 20 where a series of vertical tubes 21 extend between upper and lower end tubes 22 and the wire 16 passes through the tubes 20, 22 in zig-zag fashion as before. The wire 16 enters the panel 20 at an aperture 23 and emerges at an aperture 24. Again, the wire 16 is connected to a high tension energiser 17 and a suitable return path is provided.

The panel 20 in FIG. 2 can be suitably connected to one or more similar panels (not shown) to form a temporary security fence by connecting together vertical tubes 21 at the ends of adjacent panels 20 by means of suitable ties. An earth return or a return wire can be used to provide a return path to the energiser 17 from the last panel.

Figure 3:
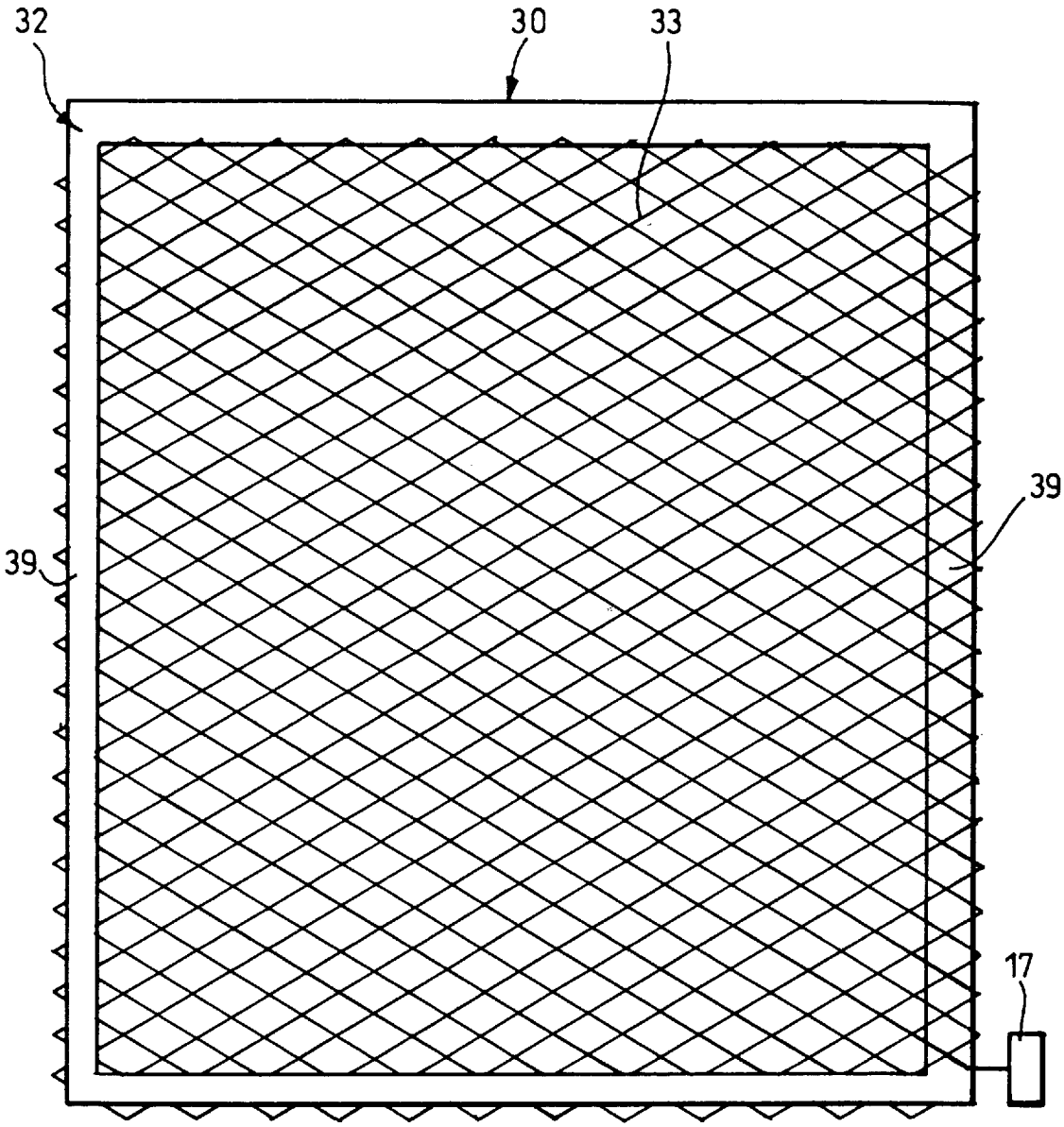
FIG. 3 is a view of a mesh panel in accordance with the invention.
Figure 4:
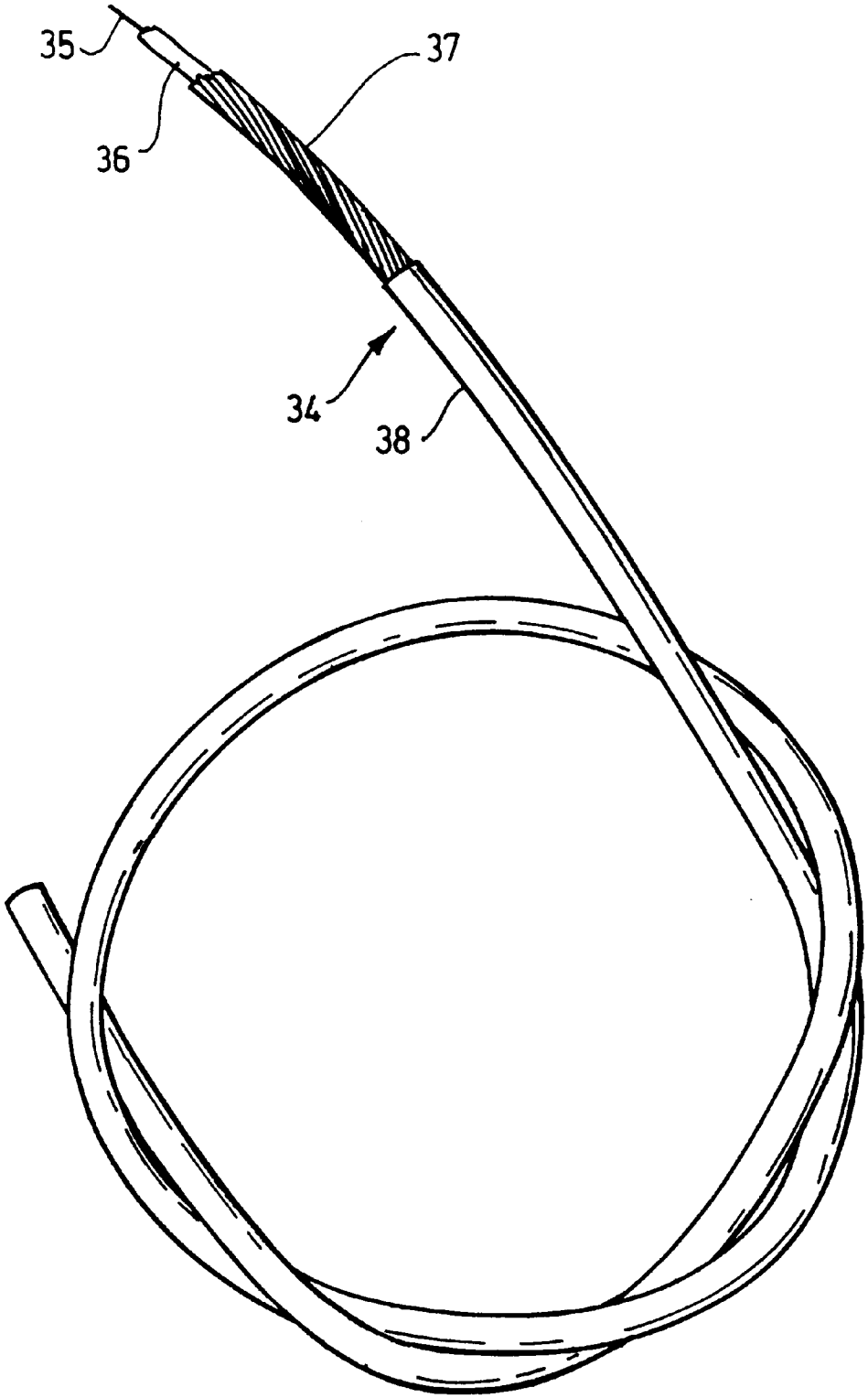
FIG. 4 is a view of a length of wire of the kind used to form the mesh panel shown in FIG. 3.

FIG. 3 shows a panel 30 comprising a frame 32 supporting a chain-link or woven mesh 33 constructed from wire 34 shown in FIG. 4. The wire comprises a copper conductor 35 surrounded by an insulating sleeve 36, the sleeve 36 itself being surrounded by a high tensile steel galvanised earth screen 37. The earth screen 37 is insulated by a sleeve 38.

If desired, a conductive wire could be formed into a grid or other arrangement and then dipped in plastics material to form a panel, the plastics forming an insulative coating for the wire.

The energiser 17 supplies high tension voltage to the copper conductor 35 and the earth screen 37 can be used to provide a return path to the energiser.

Any attempts to cut through the mesh 33, say, with bolt cutters, will result in the person involved possibly receiving an electric shock as the bolt cutters cut through the insulation 36 and make contact with the copper conductor 35.

The panel 30 can be suitably connected to adjacent panels by using ties between adjacent vertical members 39 of the frame 32. The wire of one panel can be suitably interconnected to the wire of the adjacent panel so that high tension voltage from the energiser 17 can be applied to all the interconnected panels.

Figure 5:
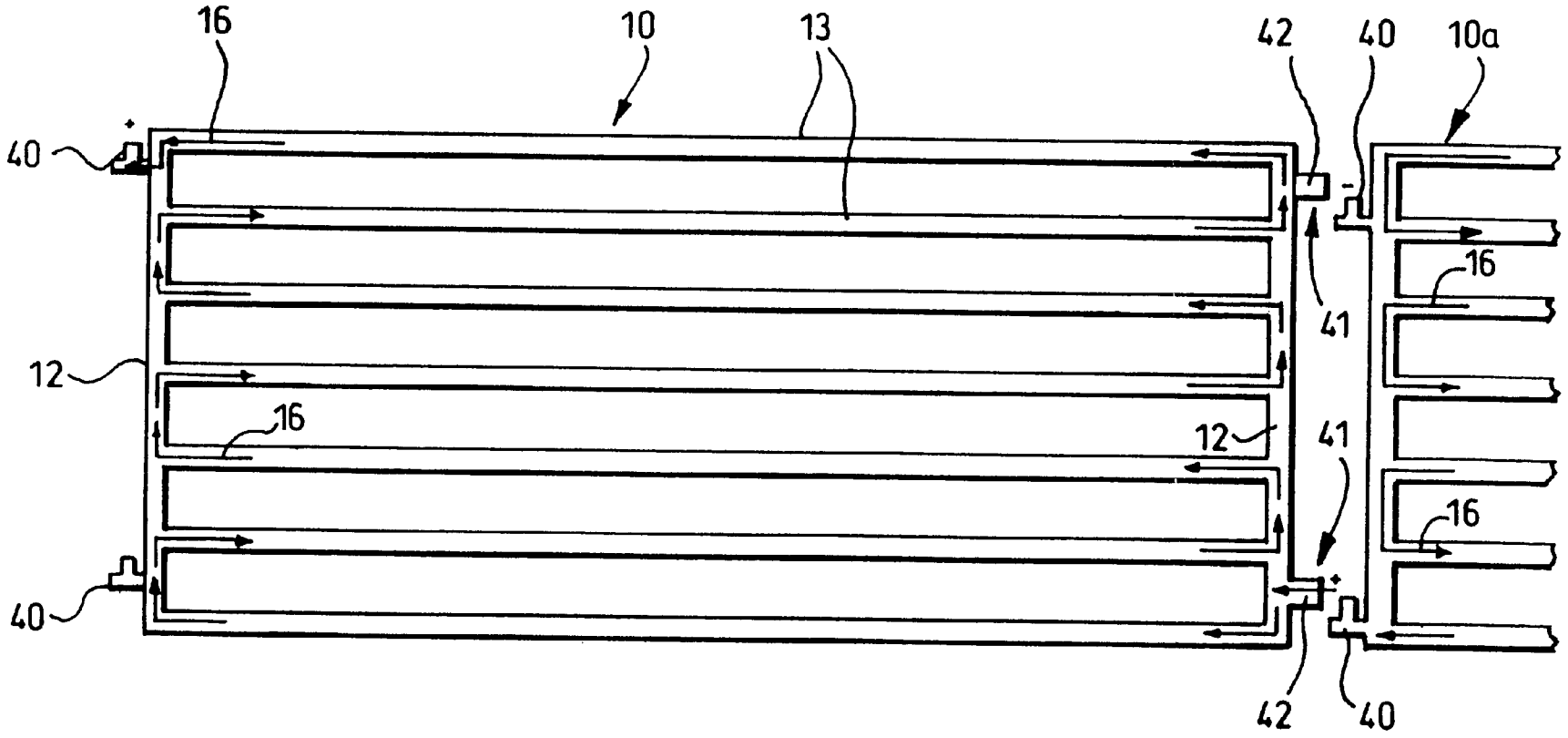
FIG. 5 is a view of a fence panel of the kind similar to that shown in FIG. 1 but having hinge-like connectors thereon by which it can be connected to an adjacent similar fence panel.

FIG. 5 shows the way in which a panel 10 similar to that shown in FIG. 1 can be connected to an adjacent panel 10*a* by using hinge-like connectors 41 comprising male connector parts 40 on the left hand end tube 12 of panel 10*a* which co-operate with female connector parts 42 on the right hand end tube 12 of the panel 10. The connector 41 constitutes the aforesaid connector means and examples of suitable connectors are described hereinafter with reference to FIGS. 16, 17 and 18.

The wire 16 passes through the tubes 12, 13 of the panels and have their conductive sections extending into the male and female connector parts 40, 42. When the male connector parts 40 enter the female connector parts 42, the conductive sections of the wires 16 of the panels 10, 10*a* interconnect electrically in the connectors 41 without making contact with the steel-work of the panels. In that way, the high tension voltage is not applied to the metal material forming the panels. The connector parts 40, 42 permit hinging movement to take place between the panels 10, 10*a* making it easy to arrange the panels around an area to be protected. Wire 16 will extend from one of the panels for connection to the energiser 17 (not shown in FIG. 5) and a suitable return path will be provided for the wiring.

Figure 6:
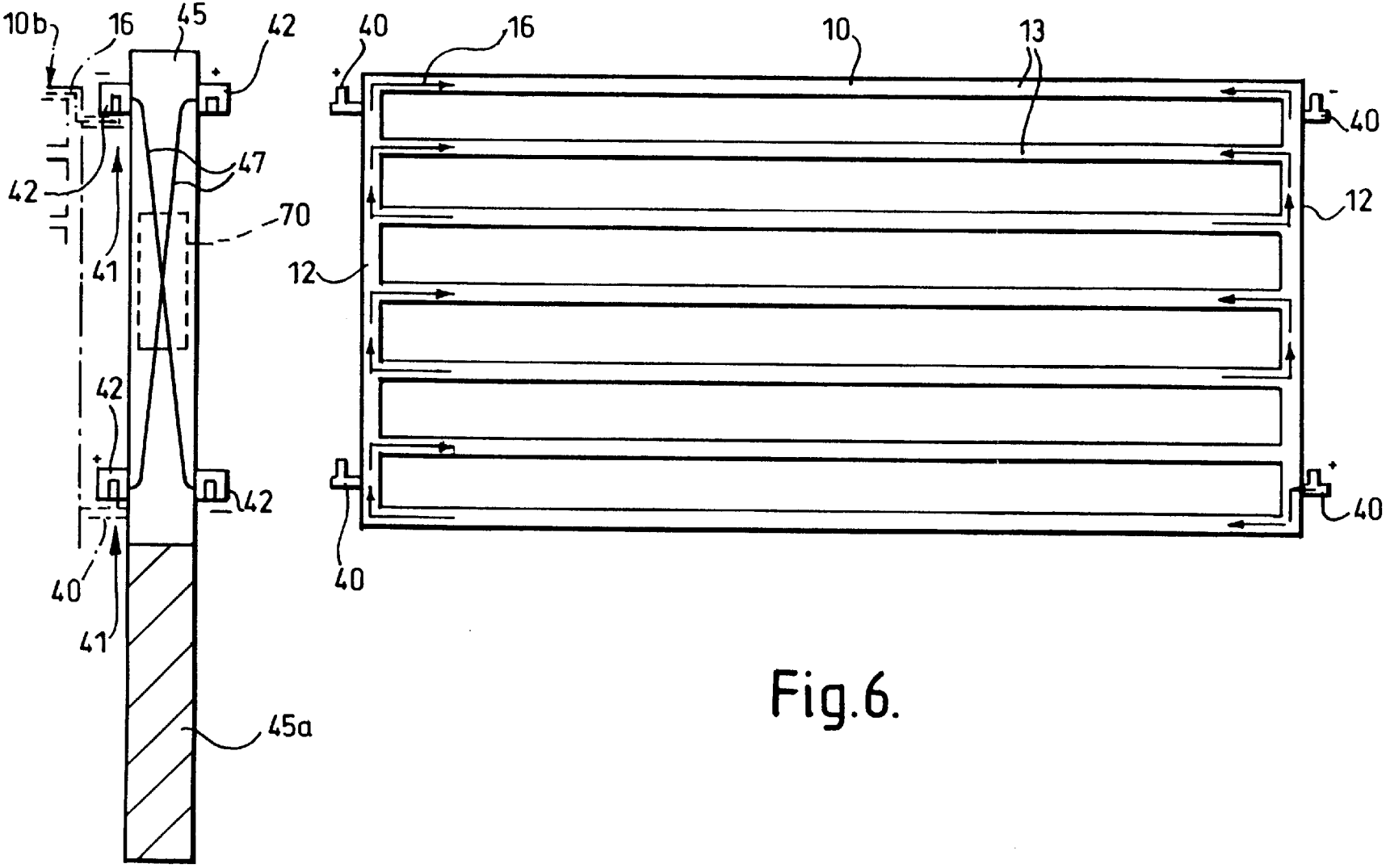
FIG. 6 illustrates a fence post and panel, the fence post having connectors thereon to enable the fence panel to be connected thereto.

FIG. 6 shows the way in which a panel 10 similar to that shown in FIG. 1, and having male connector parts 40 of connectors 41 on each end tube 12, can be connected to an adjacent similar panel 10*b* via an intermediate free-standing post 45. The post 45 may be provided with a suitable base, eg a concrete block which rests on the ground and from which the post extends upwardly. However, if desired, the post may have a lower section which can be sunk into the ground.

The post 45 carries four female connector parts 42 and diagonally opposed connector parts 42 are interconnected by means of wires 47. In that way, the wires 16 of panels 10, 10*b* will be electrically interconnected through the post 45 when the male connector parts 40 enter the female connector parts 42. The male connector parts 40 on the right hand end tube 12 can also co-operate with female connector parts 42 on a similar post 45 (not shown).

Again, wire 16 from one of the panels 10 will be connected to an energiser (not shown in FIG. 6) and a suitable electric return path will be provided.

Figure 7:
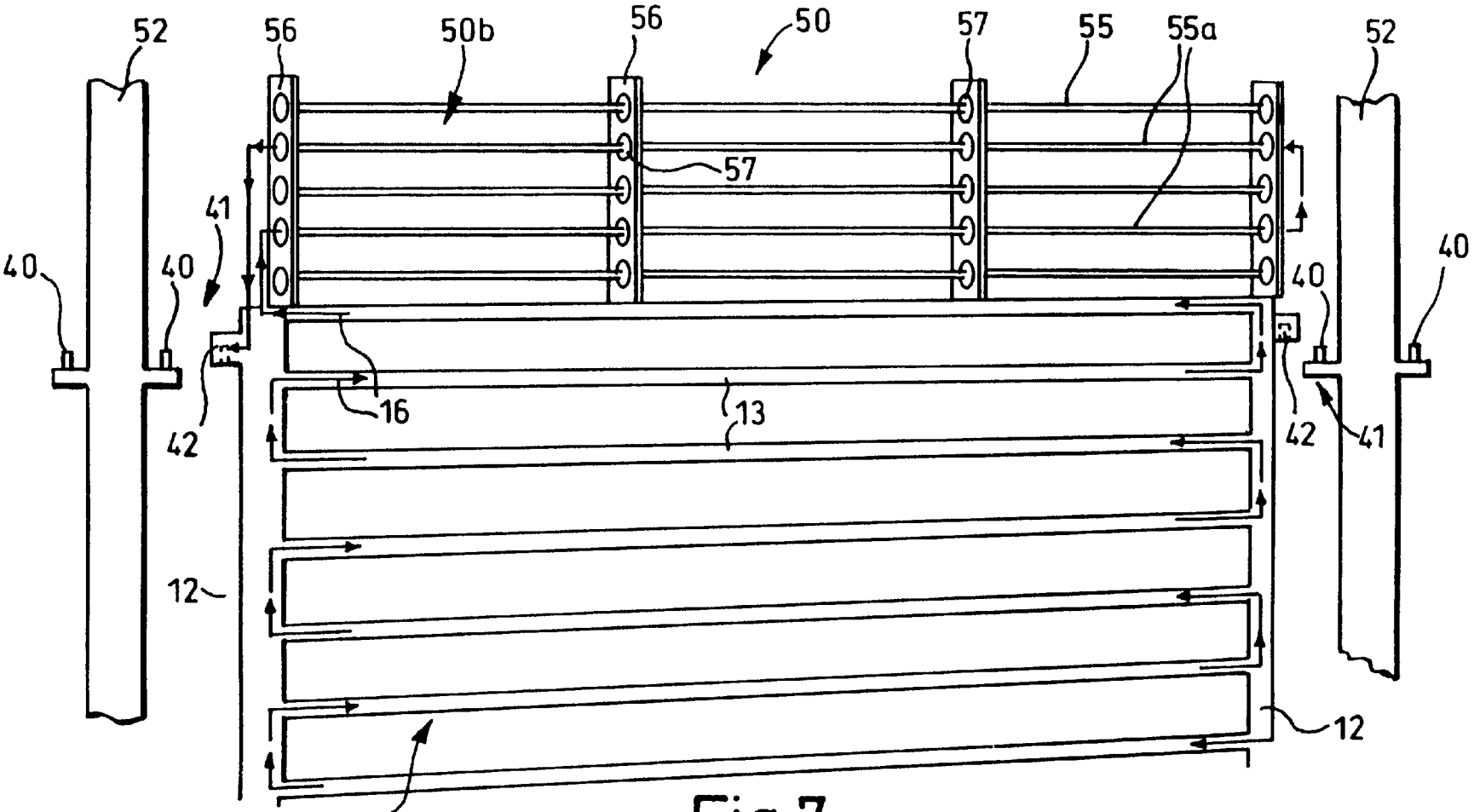
FIG. 7 illustrates the way in which a secondary panel can be positioned above a lower panel in accordance with the invention.

In FIG. 7, a panel 50 is to be mounted on posts 52 by connectors 41 comprising male connector parts 40 on each post and female connector parts 42 at the ends of the panel 50. Again, the posts 52 may be free-standing with suitable ground engaging bases.

The panel 50 comprises a lower section 50*a* of similar construction to the panel 10 and having insulated wires 16 passing therethrough in zig-zag fashion as before. The panel also includes an upper section 50*b* which carries a series of exposed non-insulated wires 55 supported by means of upright bars 56 and insulators 57. The wire 16 is connected to two wires 55*a* as shown. The upper panel section 50*b* will normally be positioned at a height which is well out of reach of the average person. However, an intruder attempting to climb a security fence made from panels 50 is likely to make contact with the wires 55*a* and will risk receiving an electric shock from wires 55*a*. Any one attempting to cut through the lower panel section 50*a* will make contact with the wire 16 and, again, will risk receiving an electric shock.

The upper section 50*b* may have its upright bars 56 formed with downwardly projecting extensions (not shown) located in the end tubes 12 from which the horizontal tubes 13 of the lower section extend. In that way, the panel 50 is effectively formed by an assembly of upper and lower prefabricated panels.

A suitable energiser arrangement is provided for the panel 50 so as to electrify temporary fencing made up from a series of interconnected panels. Again, a suitable electrical return path will be provided. If desired, the upper panel section 50*b* could be electrically independent of the lower panel section 50*a* and separately energised.

Figure 8:
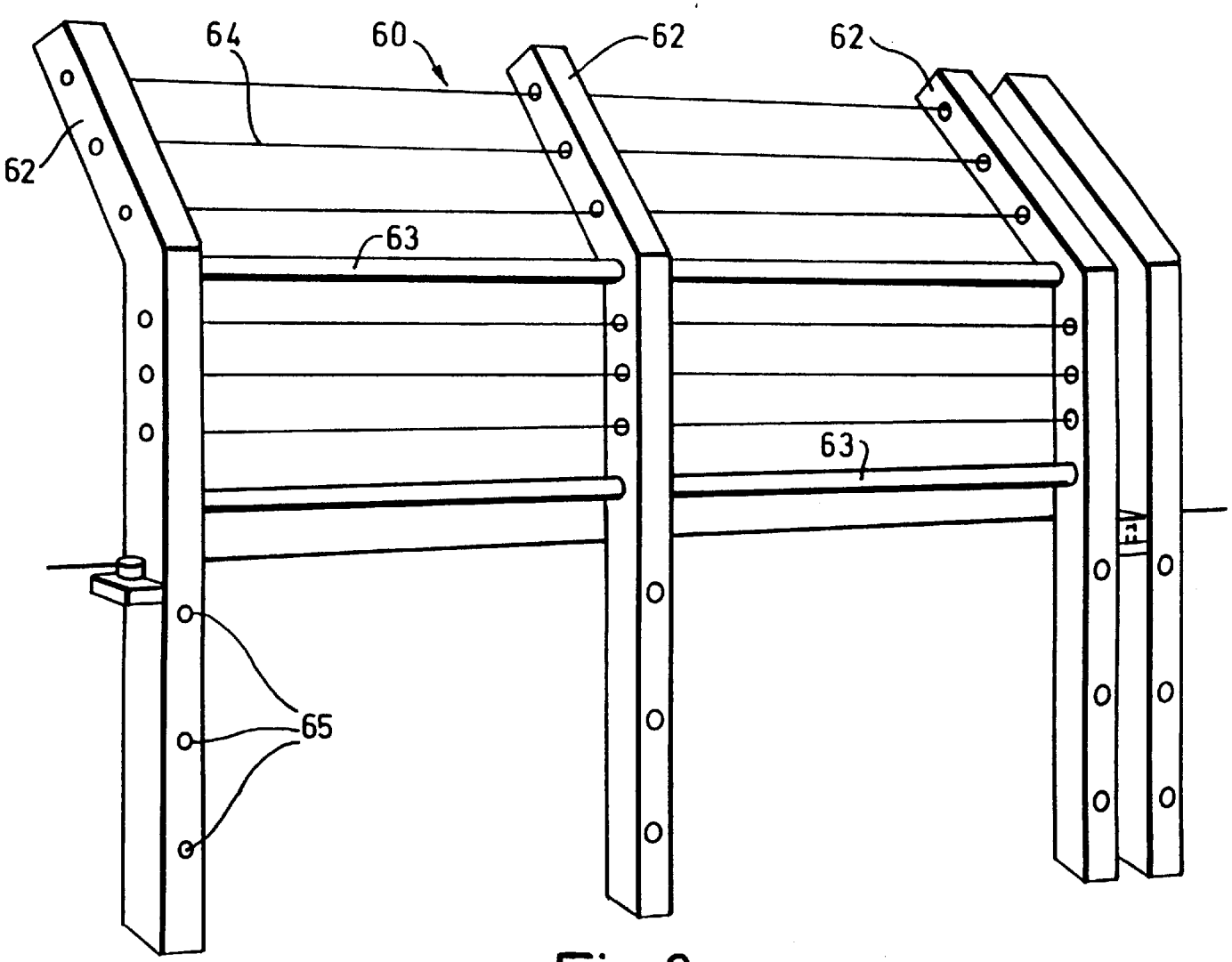
FIG. 8 illustrates a panel in accordance with the invention which can be mounted on an existing wall or other surface.

FIG. 8 shows a panel 60 comprising three upright posts 62 which are interconnected by parallel bars 63. Wiring 64 is suitably held in tension between the posts 62. The wiring 64 may comprise a continuous wire arranged in zig-zag fashion or it may comprise single strands of wire at least some of which are suitably electrically connected to each other. The wiring 64 may be connected to the posts 62 via insulators on the posts and/or the posts 62 may be electrically insulative.

The posts 62 are formed with through holes 65 to enable the panel 60 to be bolted to an existing wall, a fence or to a building adjacent the roof. The wiring 64 or selected wires thereof are connected to a high tension energiser (not shown). The panel 60 will normally be well out of reach of a normal person. However, anyone attempting to climb over the fence or wall or onto the roof of the building is likely to make contact with the wiring 64 and receive an electric shock.

If desired, a suitable transponder (indicated at 70 in FIG. 6) can be provided at intervals on the fencing (or on posts therefor as in FIG. 6) which will sense when electrical contact is made with the high tension wiring and will transmit a signal to a central control unit (not shown) to indicate a breach in the fence. The control unit will preferably identify the transponder 70 sending the signal thereby readily indicating the section of the fence concerned.

Figure 9:
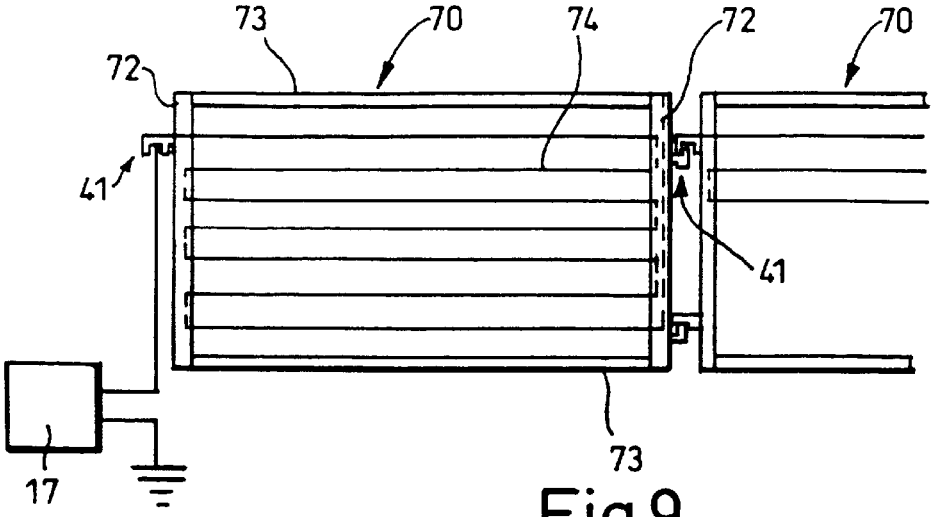
FIG. 9 illustrates a panel in accordance with the present invention having exposed wiring.

Looking at FIG. 9, a panel 70 comprises vertical end members 72 interconnected by upper and lower cross members 73. An exposed wire 74, ie one which is not covered by an insulating coating or sheath, extends in zig-zag fashion between the vertical end members 72 and is connected to an energiser 17 which applies a pulsed high tension voltage to the wire. Where the end members are made from metal, the wire 74 is suitably insulated from the end members for example by insulation material carried by the end members or by the wire 74 at the places where it is supported by the end members. Such a panel can be connected to adjacent panels 70 via connectors 41 whereby interconnection of the panels 70 will result in an electrical connection being made between the wiring 74 of the panels. An earth return or a return wire can be used to provide a return path to the energiser 17 from the last panel 70.

Figure 10:
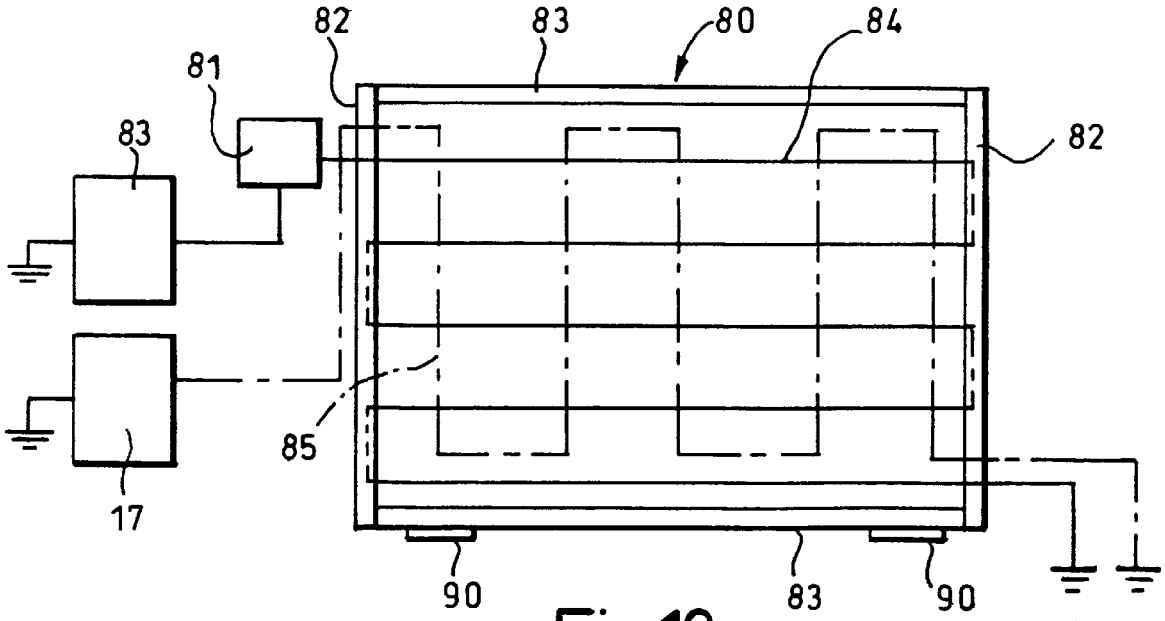
FIG. 10 illustrates a panel which combines high and low tension voltage wiring.

FIG. 10 shows a panel 80 which comprises vertical end members 82 interconnected by upper and lower cross members 83. Low tension voltage wiring 84 is arranged in zig-zag fashion between the vertical end members 82 and is connected to a source 83 of low tension voltage.

The low tension voltage circuit forms part of a suitable alarm system 81. High tension wiring 85 is also carried by the panel 80 so as to be superimposed by normally spaced from the low tension wiring 84 to avoid electrical contact therewith. The high tension wiring 85 is suitably connected to an energizer 17 which can provide an impulsed high tension voltage. Neither the low tension wiring 84 nor the high tension wiring 85 carries electrical insulation such as a sheathing. In that way, an electrically conductive path will be created between the high and low tension wires 84, 85 if adjacent superimposed wires are moved into contact with each other. The panel 80 can be connected to adjacent similar panels and the high and low tension wiring 84, 85 of one panel can be connected to the high and low tension wiring respectively of the next panel. In that respect, a connector 41 as shown in 18 could be used. Earth returns for the high and low tension wiring 84, 85 or suitable return wiring can be used.

In the daytime when there is likely to be personnel in the vicinity of an area protected by a fence made up from a number of the panels 80, low tension only is applied to the panels through wiring 84. In the event that an intruder attempts to climb the fence, it is likely that the intruder will displace some of the wiring and will cause some of the low tension wiring 84 and adjacent but non-electrified high tension wiring 85 to move into contact with each other. An electrical short circuit will then be sensed in the alarm system 81 and an alarm will be actuated to signal the attempted intrusion. At night time when the protected area may not be manned by personnel, the high tension wiring 85 is electrified by the energizer 17 so that the intruder runs the risk of receiving and electric shock on coming into contact with the high tension wire 85.

Figure 11:
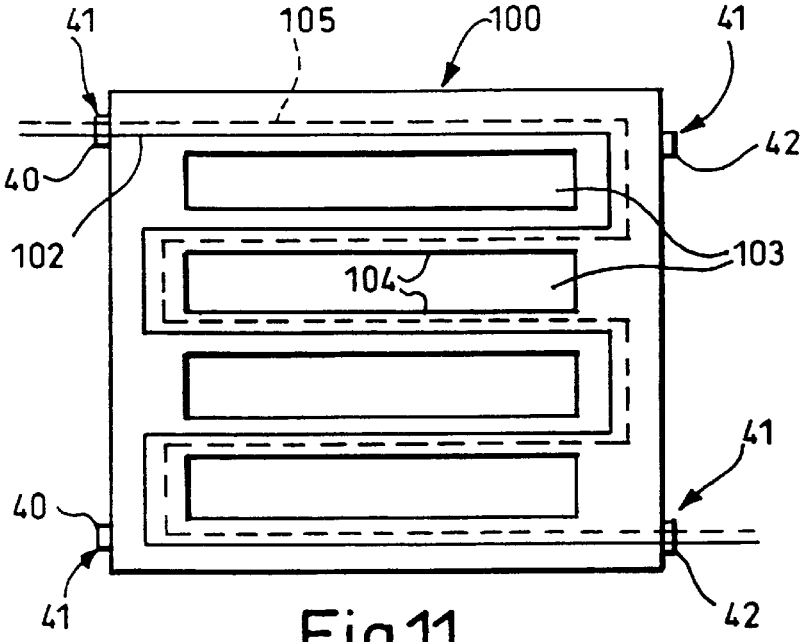
FIG. 11 illustrates one form of moulded panel in accordance with the invention.

In FIG. 11, a panel 100 is shown which is moulded from a suitable plastics material such as polypropylene. Wire 102 is moulded into the panel during the panel moulding process and male and female parts 40, 42 of connectors 41 may be moulded into the panel. The moulding tool may be designed to create open areas 103 separated by lands 104 through which the wire 102 passes. If desired a second wire 105 can be moulded into the panel 100 so that the panel can conduct both high and low tension voltages. The wires 102, 105 are not in electrical contact with each other. Panels 100 can be interconnected to form a temporary security fence and a suitable earth return or return wiring can be used. Twin wires such as wires 102, 105 could be used in the panels shown in FIGS. 1 and 2.

FIG. 12 shows a different type of moulded panel 110 where two wires 111, 112 follow runs which are transverse to each other. Again, the moulding tool may be designed to create open areas 113 separated by lands 114 through which the wires pass. The panel 110 can carry male and female parts (not shown) of connectors 41 to enable a number of the panels 110 to be connected together to form a temporary security fence. The wires 111, 112 can carry high and low tension voltage respectively and are not in electrical contact with each other.

An intruder attempting to cut through the lands 104, 114 in the panels 100, 110 runs the risk of receiving an electric shock and sounding an alarm where a monitoring type energiser 17 is used.

If desired, the moulded panel can be made in two halves 115, 116 as shown in FIG. 12*a*. The two parts have, eg, projection and socket snap-fit locators 117*a*, 117*b* moulded therein and channels 118 for one or more wires 111, 112. The wires are laid in the channels 118 prior to the panel halves 115, 116 being snapped together.

FIG. 13 shows the way in which all edges of a portable panel 120 can be provided with male connector parts 40 and female connector parts 42 of connectors 41. In that way, an upper panel 120*a* can easily be fitted to the panel 120 and electrically connected thereto to provide an arrangement similar to that shown in FIG. 7. The hinge connection provided by the connectors 41 enable the upper panel 120*a* to be tilted as shown in FIG. 13*a*. The panel 120 can be constructed by methods described with respect to earlier Figures herein. Such an arrangement will also enable several panels 120, 120*a* to be assembled together to form a barrier such as a cage or crate.

FIG. 14 shows an arrangement in which a panel 121 having wire 122 housed therein includes a door 123. The panel 121 can be constructed by any of the methods described with reference to the earlier Figures. The panel 121 shown is formed by moulding and has open areas 124. The door 123 is connected to the panel 121 by connectors 41 and a wire 125 in the door 123 is connected to the wire 122 through the connectors 41. The door 123 is also moulded in the example shown and defines open areas 126. A door-operated switch 128 is provided and is shown in detail in FIG. 15. The switch 128 provides an indication that the door 123 has been opened.

Looking at FIG. 15, the panel 121 carries a switch housing 130 on which two contacts 132 are mounted. The contacts 132 are insulated from the housing 130 by means of insulating material 133. The housing 130 has a front plate 134 formed with two apertures 135. The apertures 135 are associated with closing plates 136 which are normally held against the front plate by springs 137. The springs react against the opposite side of the housing and surround (but are spaced from) the contacts 132. The closing plates 136 are electrically connected to the contacts 132. The front plate 134, contacts 132 and closing plates 136 are made of electrically conductive material. The contacts 132 are suitably connected to an alarm circuit (not shown) and the front plate 134 is also connected to the alarm circuit. In the position of the switch shown in FIG. 15, the alarm circuit is completed to energise the alarm. The door 123 carries a switching member 140 which carries two prongs 142. When the door 123 is closed, the prongs 142 enter the apertures 135 and push the closing plates 136 clear of the front plate 134 as shown in broken lines. The action of the prongs 142 therefore breaks the alarm circuit and the alarm is place din a standby condition. If the door is opened, the prongs withdraw from the apertures 135 and allow the switch 128 to take up its FIG. 15 position and operate the alarm.

Reference is now made to FIGS. 16 to 18 which illustrate various types of connectors 41 for use with panels as described above, In FIGS. 16 to 18 the adjacent panels are designated pa and pb.

In FIG. 16 panel pa has a male connector part 40 comprising a mounting 140 formed with a bore 142 which houses an annular insulating sleeve 143. The sleeve 143 receives a rotary spigot or pin 144 having its upper end formed with a bayonet-fit shaped recess 145. A sleeve 146 of insulating material is arranged on the pin 144 immediately beneath the recess 145. A washer 147 is positioned between a head of the pin 144 and the mounting 140 and is electrically connected to a wire 148 in panel pa. The washer 147 abuts the insulating sleeve 143 but not the mounting 140. The panel pb has a mounting 141 defining a female connector part 42. The mounting 141 houses an insulation socket 141*a* through which passes diametrically a wire 149 of the panel pb. Alternatively, the wire 149 can be electrically connected to a rigid diametral peg extending through the socket 141*a*. Normally, there will be at least two connectors 41 on the adjacent edges of the panels pa and pb.

To interconnect the panels pa and pb, the pin 144 of each connector 41 is rotated through 90 degrees from the position shown in FIG. 16 and then inserted into the socket 141*a*. In that way, the wire 149 or peg will enter the recess 145 in the pin. The pin 144 is then rotated through an angle to cause the wire 149 or peg to enter undercut parts 145*a* of the recess 145 to prevent axial withdrawal of the pin and to connect the wiring 148, 149 through the pin 144. The insulation sleeve 146 prevents shorting of the mountings 140 and 141 of the panels pa and pb through the pin 144. Also, the upper surface of the sleeve 146 stands proud of the top of mounting 140 to prevent direct contact between the two mountings 140, 141. The pin 144 is freely rotatable in the mounting 140 to enable to panels pa and pb to be hinged relative to each other.

In FIG. 17, the mounting 140 of the panel pa has its male connector part 40 formed by an upstanding pin or spigot 150 which is made of insulating material. The pin 150 carries an electrical contact 152 which is electrically connected to the wire 148 of the panel pa. The contact 152 is of the same diameter as the pin 150. The mounting 141 of the panel pb houses an insulating socket 153 which itself houses an electrically conductive socket 154 connected to the wire 149 of the panel pb. The sockets 153, 154 are of complementary diameter to the pin 150 and contact 152. To interconnect the panels pa and pb, the pin 150 of each connector 41 is inserted into the female member 42 so that the contact 150 enters the socket 154. The interconnection of the panels in that way electrically interconnects the wires 148, 149. The pin 150 can rotate in the female member 42 to enable the panels pa and pb to be hinged relative to each other.

FIG. 18 shows a modified version of the connector shown in FIG. 17 to connect two wires 148, 148*a* in panel pa to respective wires 149, 149*a* in panel pb. It will be seen that the contact 152 is effectively split to form contacts 152*a* and 152*b* insulated from each other and the socket 154 is also split to form a small socket 154*a* and an adjacent sleeve 154*b*. The electrical connections to the wires 148*a*, 148*b* and 149*a* and 149*b* from the contacts 152*a*, 152*b* and from the socket 154*a* and sleeve 154*b* respectively can be seen from FIG. 18. When the panels pa and pb are interconnected through the connector 41 in FIG. 18, the contact 152*a* makes electrical contact with socket 154*a* and the contact 152*b* makes electrical contact with the sleeve 154*b*.

It is envisaged that the FIG. 16 connector could be adapted to enable two wires in panel pa to be connected to two respective wires in panel pb.

It will be appreciated that prefabricated panels made in accordance with the invention will be easy to transport and assemble and will present a much more effective deterrent to intruders than panels which are simply arranged to provide an alarm.

Although a preferred use of the fence panels in accordance with the invention is to provide temporary security fencing, the panels could, as an option, be assembled to form a permanent security fence.

A wire return path to enable the final fence panel in a run to be electrically connected to the high tension voltage energiser (or low voltage source where a second wire is provided in each panel as, eg in FIG. 10) may be provided in each panel. The returns are then suitably interconnected from panel to panel. Where a single high tension wire is used in each panel, connectors 41 as shown in FIG. 18 could be used to enable a return path to be provided by return wires in the panels, the return wire, eg wire 148, in one panel pa being connected to the return wire, eg wire 149, of adjacent panel pb through the connector 41.

Operation of an alarm has been mentioned with respect to certain panels described herein. However, it will be appreciated that such an alarm arrangement as provided, eg by the use of the G218 H/V L/V monitoring system 17, can be used in conjunction with the other panels and fencing described herein.

The risk of an intruder receiving an electric shock with panels made in accordance with the invention provides an extremely useful deterrent. Therefore a fence or other barrier constructed from the panels will provide a very effective and easy to construct deterrent against intrusion.

Whilst the system 17 is preferably arranged to provide monitoring of panels, an energiser which provides high tension alone could be used where monitoring is not required.

FIG. 19 shows parts of a kit 200 for erection into a fence 202. The kit 200 comprises a post 204 which includes wire guides 206 of known types equally spaced along the upper part of its length. The post 204 is made of insulating material such as glass fibre reinforced plastic material. Each wire guide 206 is made from a length of wire and has a helical central part 208 which surrounds and resiliently engages the post 204 and two terminal arms 210 which are turned inwards so that their ends overlap in a horizontal plane. A horizontal wire 212 can thus be retained loosely between the two arms 210 of a guide 206 and the body of the post 204. At the base of the post 204 is provided an annular rubber member 214 which encircles the post 204.

FIG. 20 shows a post 204 of a further embodiment. The same reference numerals will be used for equivalent features. In this case, the post 204 is a metal profile and two annular rubber members 214 are provided spaced apart from one another on the base of the post 204. The wire guides 216 of this embodiment are of a different known type and are moulded from insulating plastic and are generally circular with an attachment for fixing to the metal profile post 204 and a bore to receive a wire 212.

FIG. 21 shows the post 204 of FIG. 20 in use in the erected kit. An existing temporary fence 218 is shown. Each section of the existing fence 218 comprises a metal mesh panel 220 which is connected at each end to a tubular metal member 222. Two tubular members 222 of adjacent panels 218 are supported adjacent another and received in adjacent upright bores (not shown) in a concrete block 224. The upper end of each tubular member 222 is open and receives the lower end of a post 204 of the kit 200 such that the annular resilient member or members 214 resiliently engage the inner wall of the tube 222 to mount each post 204. Wires 212 extend horizontally between aligned wire guides 216 on each post 204. The wires 212 are connected to an electrical source in known manner. The metal existing temporary fence 218 is connected to earth in known manner.

The complete fence thus consists of the existing fence 218 and an electrified fence immediately above it. If someone touches the existing fence 218 they will not be shocked as the wires 212 are insulated from the fence 218 by the wire guides 216 and rubber mounting members 214. However if they hold the existing fence 218 and reach up to touch the wires 212 they will receive a shock.

The post 204 and associated parts of the alternative kit shown in FIG. 20 could also be used above the existing fence 218 in the same way.

The term "wire" used herein includes not only metallic material but also includes other electrically conductive filamentary material suitable for conducting the high and low tension voltages.

I claim:

1. An electric fence kit for erection of a temporary electric fence on an existing fence, the kit comprising:

a plurality of wires to be electrified, at least two posts, mounting means for removably mounting the said posts on top of the existing fence, and a plurality of guide means for each said post, each said guide means being for guiding one of said wires, in use.

2. A kit according to claim 1 in which the guide means are insulating.

3. A kit according to claim 2 in which the posts are made from metal.

4. A kit according to claim 1 in which the posts are insulating.

5. A kit according to claim 4 in which the guide means are made of wire.

6. A kit according to claim 1 in which each mounting means comprises means for mounting the post in an upwardly facing opening defined in the existing fence.

7. A kit according to claim 6 in which each mounting means comprises a mounting member of resilient material.

8. A kit according to claim 7 in which each mounting member comprises a ring of resilient material to be resiliently received on one of the posts.

9. The combination of an existing fence and an electric fence erected from a kit according to claim 1, the posts being mounted on the existing fence by the mounting means, a plurality of guide means being carried by each post and the wires extending in spaced apart arrangement between the guide means.

10. A combination according to claim 9 in which the electric fence is arranged immediately above the existing fence.

11. A combination according to claim 9 in which the existing fence includes tubular upright members, each tubular upright member defining an upwardly facing opening, and each post of the electric fence is mounted by the mounting means in the said upwardly facing opening defined by the end of one of said tubular upright members.

12. A combination according to claim 9 in which the existing fence is a temporary fence.

13. A combination according to claim 9 in which the existing fence is a non-electric fence.

14. A combination according to claim 9 in which the existing fence is conductive and connected to earth.

15. A combination according to claim 9, the combination including a source of high tension electrical voltage connected to each said wire.

16. A kit according to claim 1, further comprising a source of high tension electrical voltage.

17. An electric fence kit for erection of a removable electric fence on an existing fence, the kit comprising:

a plurality of wires adapted to be electrified with a current capable of giving a shock when contacted when said kit is in use;

at least two posts adapted to be removably mounted on top of the existing fence; and a plurality of guides on each of said posts, each of said guides being adapted to secure one of said wires relative to its post when said kit is in use as a removable electric fence.

* * * * *